US006842144B2

(12) United States Patent
Guo et al.

(10) Patent No.: US 6,842,144 B2
(45) Date of Patent: Jan. 11, 2005

(54) HIGH GAIN INTEGRATED ANTENNA AND DEVICES THEREFROM

(75) Inventors: Xiaoling Guo, Gainesville, FL (US); Kenneth O, Gainesville, FL (US); Ran Li, Gainesville, FL (US)

(73) Assignee: University of Florida Research Foundation, Inc., Gainesville, FL (US)

( * ) Notice: Subject to any disclaimer, the term of this patent is extended or adjusted under 35 U.S.C. 154(b) by 45 days.

(21) Appl. No.: 10/458,645

(22) Filed: Jun. 10, 2003

(65) Prior Publication Data

US 2004/0008142 A1 Jan. 15, 2004

Related U.S. Application Data

(60) Provisional application No. 60/387,326, filed on Jun. 10, 2002.

(51) Int. Cl.[7] ..... H01Q 1/38
(52) U.S. Cl. ..... 343/700 MS; 257/728
(58) Field of Search ..... 343/700 MS, 702, 343/850, 853; 257/604, 624, 625, 659, 664, 728

(56) References Cited

U.S. PATENT DOCUMENTS

| | | | | | |
|---|---|---|---|---|---|
| 5,202,752 | A | | 4/1993 | Honjo | 257/678 |
| 5,248,947 | A | * | 9/1993 | Shiga | 331/44 |
| 5,449,953 | A | * | 9/1995 | Nathanson et al. | 257/728 |
| 5,455,594 | A | | 10/1995 | Blasing et al. | 343/700 MS |
| 5,767,808 | A | | 6/1998 | Robbins et al. | 343/700 MS |
| 6,127,989 | A | * | 10/2000 | Kunz | 343/895 |
| 6,150,974 | A | | 11/2000 | Tasaka et al. | 342/53 |
| 6,271,792 | B1 | | 8/2001 | Sletten et al. | 343/700 MS |
| 6,384,785 | B1 | | 5/2002 | Kamogawa et al. | 343/700 MS |
| 6,388,623 | B1 | | 5/2002 | Sakota et al. | 343/700 MS |
| 6,486,751 | B1 | | 11/2002 | Barber et al. | 333/187 |
| 6,518,932 | B1 | | 2/2003 | Matsui et al. | 343/770 |
| 6,535,090 | B1 | | 3/2003 | Matsuzuka et al. | 333/246 |
| 2002/0126048 | A1 | | 9/2002 | Zhu et al. | 343/700 MS |
| 2002/0140608 | A1 | | 10/2002 | Zaghloul et al. | 343/700 MS |
| 2002/0149526 | A1 | | 10/2002 | Tran et al. | 343/702 |
| 2003/0020092 | A1 | | 1/2003 | Parikh et al. | 257/192 |
| 2003/0034921 | A1 | | 2/2003 | Chang et al. | 343/700 MS |
| 2003/0048095 | A1 | | 3/2003 | Zink et al. | 320/108 |

* cited by examiner

*Primary Examiner*—Hoang V Nguyen
(74) *Attorney, Agent, or Firm*—Akerman Senterfitt

(57) ABSTRACT

An integrated circuit for wireless communications includes substrate, at least one integrated antenna formed in or on the substrate, and a heat sink. At least one dielectric propagating layer is disposed between the integrated antenna and the heat sink which provides a thermal conductivity of at least 35 W/m·K and resistivity greater than 100 Ohm-cm at 25 C. The invention can be used to establish an on-chip or inter-chip wireless link over at least a 2.2 cm distance.

17 Claims, 11 Drawing Sheets

HIGH GAIN INTEGRATED ANTENNA AND DEVICES THEREFROM

CROSS-REFERENCE TO RELATED APPLICATIONS

This application claims the benefit of provisional application Ser. No. 60/387,326 filed on Jun. 10, 2002, the entirety of which is incorporated herein by reference.

STATEMENT REGARDING FEDERALLY SPONSORED RESEARCH OR DEVELOPMENT

Not applicable.

FIELD OF THE INVENTION

The invention relates to integrated circuits which include integrated antennas.

BACKGROUND

The increase in the operating frequency and projected die size of CMOS circuits to 10 $cm^2$ or more has led to the proposal of wireless interconnects based on integrated antennas. Integrated antennas can provide a high speed alternative to a conventional wired interconnection system through use of free-space (e.g. microwave) communications which travel at nearly the speed of light. Wireless communications can be both within an IC and between ICs.

The antenna gain is one of the key factors determining the feasibility of an integrated system based on integrated antennas. Such integrated systems can include one or more electronic devices, such as microprocessors. If the antenna gain can be increased, the distance between communication points within the overall circuit or circuits can be increased, or the signal quality (e.g. signal to noise ratio) can be enhanced for a constant spacing distance between communicating elements.

Previous work has inserted dielectric layers, such as wood or glass blocks, between the wafer containing the integrated antenna and a metallic heat sink to increase the antenna gain. Antenna gain is increased in this case because a low loss dielectric propagation layer is provided for the electromagnetic fields as they are guided by the antenna elements.

A low loss dielectric propagating layer can reduce the influence of the lossy metal heat sink layer generally disposed below the integrated circuit substrate, upon which the integrated antenna elements are disposed. Unfortunately, the use of low loss dielectrics which have low thermal conductivities, such as wood or glass, are generally incompatible with integrated circuits which dissipate significant power during operation.

Circuits including microprocessors can have power dissipations up to 170 W, or more. Power dissipation in electronic devices leads to heating of the circuit. Cooling measures may be required to limit junction temperatures from exceeding allowable limits of the device. Even if held within junction temperature limits, increasing chip temperatures generally degrade circuit performance and reliability of the circuit. Moreover, the speed of microprocessors is known to decrease with increasing chip temperature.

Thus, both antenna gain and heat removal are generally important factors in determining the feasibility of an integrated circuit system which includes integrated antennas. Although proximity of active devices to the heat sink reduces the junction temperature of the circuit during operation, this arrangement generally increases dielectric loss for the integrated antenna. As a result, the antenna gain is often compromised.

Thus, arrangements used to date have not been optimized for both antenna gain and heat removal. These arrangements have resulted in the inability to establish an on-chip wireless connection over a sufficient distance for certain applications, such as those requiring wireless communications over a distance of 1 cm or more.

SUMMARY OF THE INVENTION

The invention increases integrated antenna gain while not substantially degrading heat removal for integrated electronic circuits which include at least one integrated antenna. By disposing at least one dielectric propagating layer which provides high thermal conductivity along with low loss between the integrated antenna and the heat sink, on-chip wireless connection distances can be significantly increased beyond maximum reported distances.

An integrated circuit adapted for wireless communications includes a monolithic substrate including at least one integrated electronic device and at least one integrated antenna formed in or on said substrate and a heat sink. At least one dielectric propagating layer is disposed between the integrated antenna and the heat sink. The propagating layer provides a bulk thermal conductivity of at least 35 W/m·K and a resistivity of at least 100 Ohm-cm at 25 C.

The dielectric propagating layer can comprise an insert layer comprising a layer formed from a material distinct from the substrate, such as aluminum nitride (AlN), sapphire or diamond. The insert layer is preferably in intimate contact with the monolithic substrate. As used herein, the term "intimate contact" refers to the insert layer being attached or otherwise integrated to the monolithic substrate such as through a suitable deposition process, as opposed to being separate layers pressed upon one another, such as a monolithic substrate disposed on wood.

The thickness of the insert layer can be between 0.01 to 1 mm. Alternatively, the monolithic substrate can provide the dielectric propagating layer when its bulk resistivity is sufficiently high, such as a silicon substrate having a bulk resistivity of at least 100 Ohm-cm.

The circuit can provides wireless communications over a distance of at least 1.0 cm, and preferably at least 2.0 cm. As used herein "wireless communications" over a given distance refers to propagation of electromagnetic waves (e.g. microwaves) through a dielectric media, such as air, rather than by wires.

The integrated circuit can include at least a first and second integrated electronic device, the first and second integrated electronic devices each including integrated antennas. In this arrangement, the electronic devices communicate on-chip between one another over the air. The on-chip wireless communication distance can be over a distance of at least 1.0 cm, and preferably over a distance of at least 2.0 cm. The integrated electronic devices can include a microprocessor.

BRIEF DESCRIPTION OF THE DRAWINGS

A fuller understanding of the present invention and the features and benefits thereof will be accomplished upon review of the following detailed description together with the accompanying drawings, in which.

DETAILED DESCRIPTION OF THE INVENTION

Figure 1:
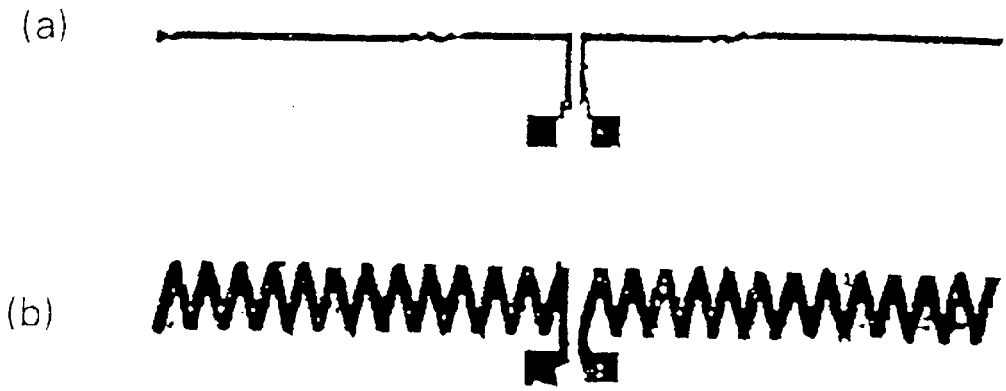
FIGS. 1(*a*) and 1(*b*) illustrate the layout of a linear and a zigzag integrated dipole antenna pair, respectively.

The invention provides improved antenna gain while not significantly degrading heat removal for integrated circuits using wireless communications which include one or more integrated antennas formed in or on the substrate. A dielectric propagating layer disposed between the heat sink and the antenna elements provides both low loss and high thermal conductivity.

The invention is applicable to both intrachip and interchip wireless communications. For example, in the case of interchip communications, multiple devices, each having integrated antennas can be formed on a common monolithic substrate and common dielectric propagating layer, the common dielectric propagating layer being connected to a common heat sink.

The heat-dissipating device that integrated circuits most commonly link to is heat sinks. Heat sinks diffuse excess heat generated. For example, a semiconductor device can include a metal (e.g. Cu) heat transfer plate on the bottom of the package to enable more efficient heat transfer of heat emanating from the semiconductor device.

The low loss dielectric propagating layer provides a low loss path through which E–M waves can propagate. The high thermal conductivity aspect of the layer facilitates efficient power transfer between the substrate and heat sink which helps improve integrated circuit operation and reliability by limiting circuit operating temperature. The low loss dielectric can provide up to about a 10 dB improvement in power transmission gain over previous work.

Thus, the invention can increase the antenna power transmission gain while not significantly degrading heat removal from the circuit and associated operating parameters. This can reduce power requirements for wireless interconnects as well as provide satisfactory heat removal, which is one of the critical requirements for microprocessors and other devices which dissipate high power levels.

The low loss dielectric layer preferably provides a thermal conductivity of at least 35 W/m·K and a resistivity greater than about 100 Ohm-cm at 25 C. Low permittivity dielectric materials generally provide high resistivity. It is preferable to use materials which provide the highest resistivities and highest thermal conductivities possible.

Exemplary layers which can satisfy both of the thermal conductivity and resistivity limits noted above include sapphire ($Al_2O_3$), diamond, AlN, and high resistivity silicon. For high resistivity silicon, for example at about 20 GHz, the silicon should generally have a resistivity of at least 20 Ohm-cm, preferably at least 100 Ohm-cm and more preferably at least 1000 Ohm-cm. When a high resistivity monolithic substrate portion is provided beneath the antenna elements, the low loss propagating layer can be provided by the monolithic substrate itself. In this case, the substrate should be at least 10 $\mu$m thick, and can be as thick as 100 $\mu$m, or more.

When low resistivity substrates are used (e.g. <1 Ohm-cm), such as to reduce latch-up susceptibility in CMOS circuits, the substrate will not generally provide a sufficiently low loss for use with the invention. In this case, a separate low loss insert layer can be disposed between the monolithic substrate (e.g. silicon) and the heat sink. The insert layer is preferably formed directly on the wafer (e.g. through a deposition process) to make intimate contact with the wafer. Intimate contact is known to improve heat transfer efficiency as compared to simple layer contact, such as where the respective layers are pressed together.

Figure 2:
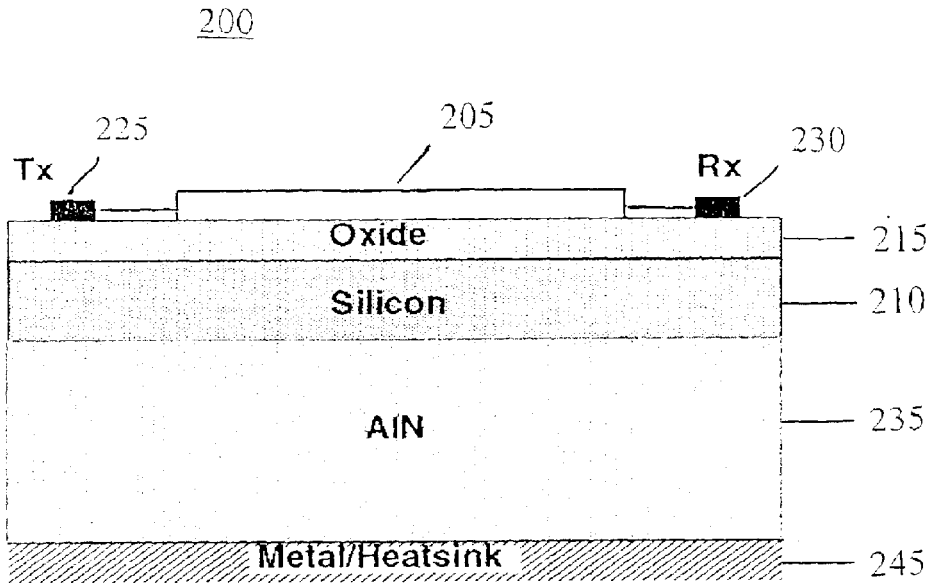
FIG. 2 illustrates an aluminum nitride (AlN) dielectric propagating layer disposed between a Si chip and a metal heat sink.

FIG. 2 illustrates an integrated circuit 200 adapted for wireless communications including a monolithic substrate 210 having at least one integrated electronic device 205 formed thereon. The integrated electronic device 205 is connected to transmit antenna 225 and receive antenna 230, the integrated antennas 215 and 220 formed on a silicon dioxide layer 215 which is shown disposed on a monolithic substrate 210 comprising silicon. Dielectric propagating layer 235 formed from aluminum nitride (AlN) is disposed below monolithic substrate 210, thus being between the integrated antennas 225 and 230 and heat sink 245. The dielectric propagating layer 235 provides a bulk thermal conductivity of at least 35 W/m·K and a resistivity of at least 100 Ohm-cm at 25 C.

As shown in FIG. 2, dielectric propagating layer 235 is embodied as an insert layer, being separate from monolithic substrate 210. Typical dielectric insert layer thicknesses are generally from 0.1 to 5 mm, but can be thicker or thinner than this range. Alternatively, the monolithic substrate can provide the dielectric propagating layer 235 when its bulk resistivity is sufficiently high, such as a silicon monolithic substrate 210 having a bulk resistivity of at least 100 Ohm-cm. In this arrangement, no insert layer is required.

The invention has been shown to increase antenna transmission gain by around 10 dB using a 0.76 mm aluminum nitride (AlN) layer disposed between a Si substrate and a metal layer. AlN provides a bulk thermal conductivity of up to about 200 W/m·K at 25 C, with diamond providing an even higher thermal conductivity. Silicon can provide a thermal conductivity up to about 145 W/m·K at 25 C, while sapphire (aluminum oxide) provides a thermal conductivity of about 35 W/m·K at 25 C.

The invention can significantly increase the transmission gain of the integrated antenna, and make a wireless clock distribution system compatible to the current practice of heat removal. This should provide improved speed and overall performance for integrated circuits including integrated antennas, such as those including microprocessors. Thus, the invention can permit a higher speed, larger die sized microprocessor adapted for wireless communications.

EXAMPLES

It should be understood that the examples and embodiments described herein are for illustrative purposes only and that various modifications or changes in light thereof will be suggested to persons skilled in the art and are to be included within the spirit and purview of this application. The invention can take other specific forms without departing from the spirit or essential attributes thereof.

To evaluate the impact of a propagating layer disposed underneath a silicon substrate for lessening the influence from a lossy metallic heat sink, linear or zigzag dipole antenna pairs (FIGS. 1(*a*) and (*b*)) were each fabricated using a single metal level process without a passivation layer and disposed on a silicon wafer. The antennas were 2 mm long, and the thickness and width of the metal lines were 2 $\mu$m and 10 $\mu$m, respectively.

As noted above, FIG. 2 shows transmit 225 and receive 230 dipole antennas disposed on a silicon dioxide 215 covered silicon wafer 210, where a AlN dielectric propagating layer 235 is disposed between the wafer 210 and a metallic heat sink 245. Although separate antennas for transmit and receive are shown in FIG. 2, as will be apparent to those having ordinary skill in the art, the invention can be practiced with a single antenna (not shown).

Figure 3:
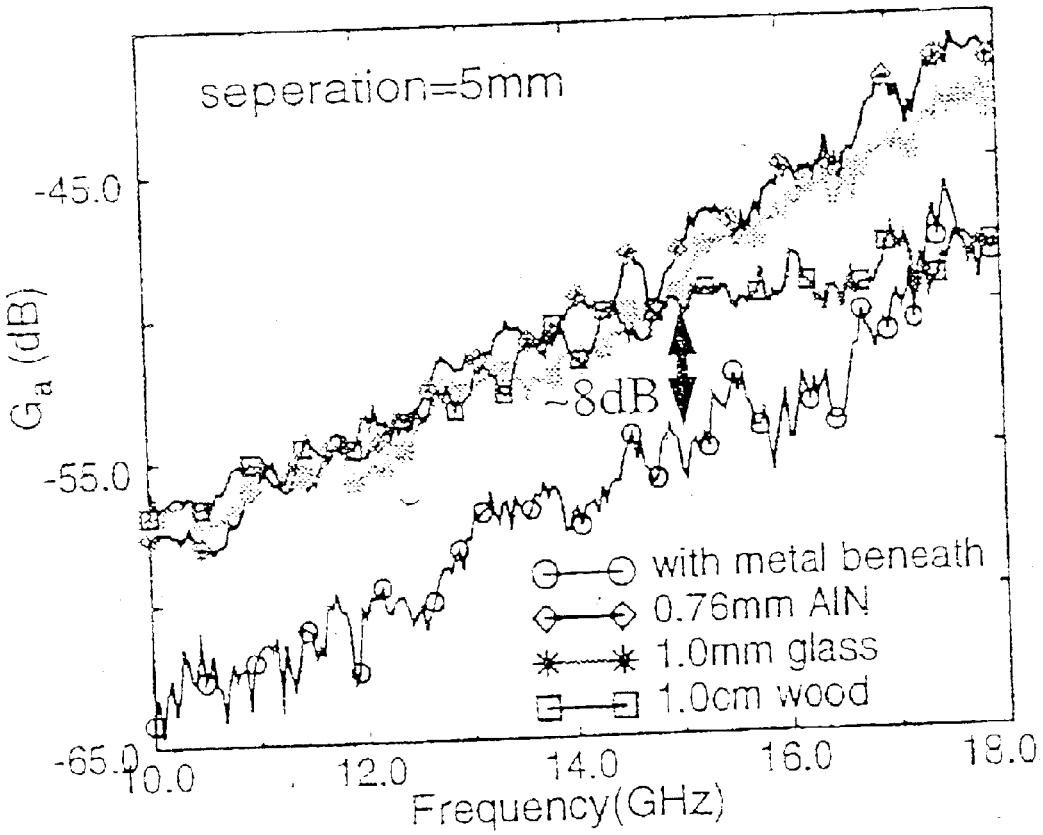
FIG. 3 illustrates the power transmission gain of an antenna including an AlN dielectric propagating layer disposed between a Si chip and metal heat sink as compared to an otherwise equivalent antenna without an AlN dielectric propagating layer.
Figure 4:
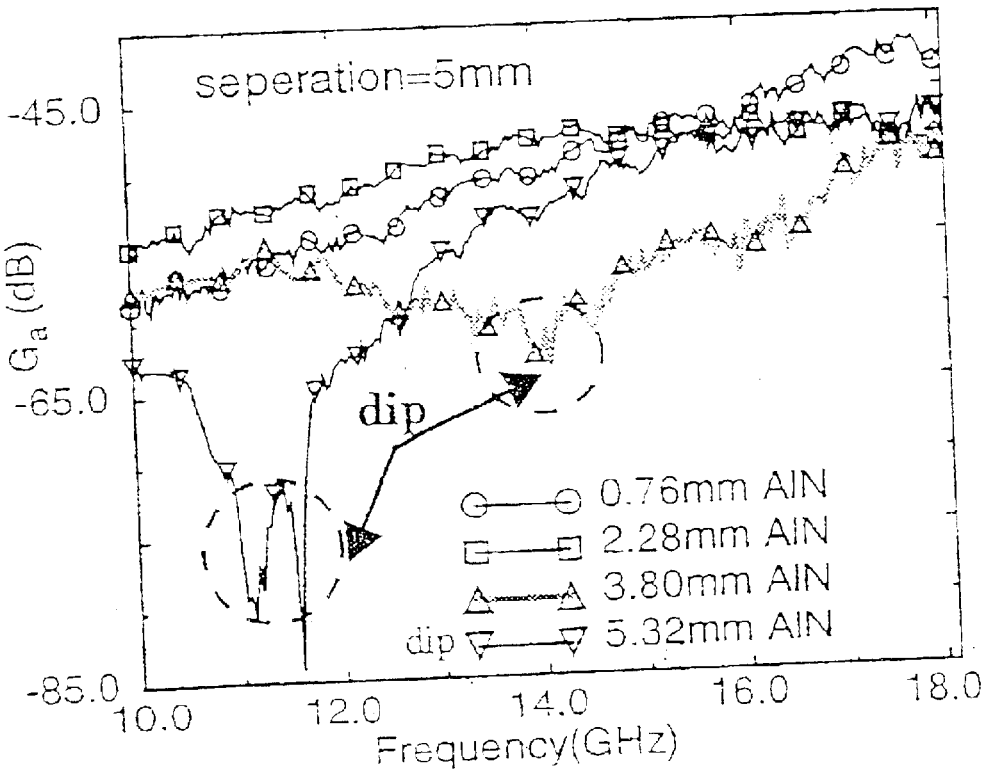
FIG. 4 illustrates power transmission gain vs. frequency for various AlN propagating layer thicknesses.

The power transmission relation between a receiving and a transmitting antenna can be represented by the well known Friis' transmission formula shown below:

$$\frac{P_R}{P_T} = |S_{21}|^2 = (1-|\Gamma_t|^2)(1-|\Gamma_r|^2)\frac{G_t G_r \lambda^2}{(4\pi R)^2} \quad (1)$$

Where $P_R$ is the received power and $P_T$ is the transmitted power, $\lambda$ is the wavelength of the radiation, R is the antenna separation, $\Gamma_t$ and $\Gamma_r$ are the reflection coefficients for the receiving and transmitting antennas, and $G_t$ and $G_r$ are the transmit and receive antenna gains, respectively. FIG. 3 compares the power transmission gain ($G_a$), as defined in equation 2 below, for the case where the heat sink is in direct contact with a wafer to when various dielectric layers (AlN, glass and wood) are disposed between the heat sink and the wafer.

$$G_a = \frac{|S_{21}|^2}{(1-|S_{11}|^2)(1-|S_{22}|^2)} \quad (2)$$

Where $S_{21}$, $S_{11}$, and $S_{22}$ are the measured S-parameters. The measured antennas were linear dipole pairs fabricated on a 20 Ω-cm Si substrate. The dipole elements were separated by 5 mm. FIG. 4 shows that $G_a$'s for the AlN and glass cases are almost the same, being about 8 dB higher than the power transmission gain for the dipole pair without the dielectric propagating layer.

Figure 5:
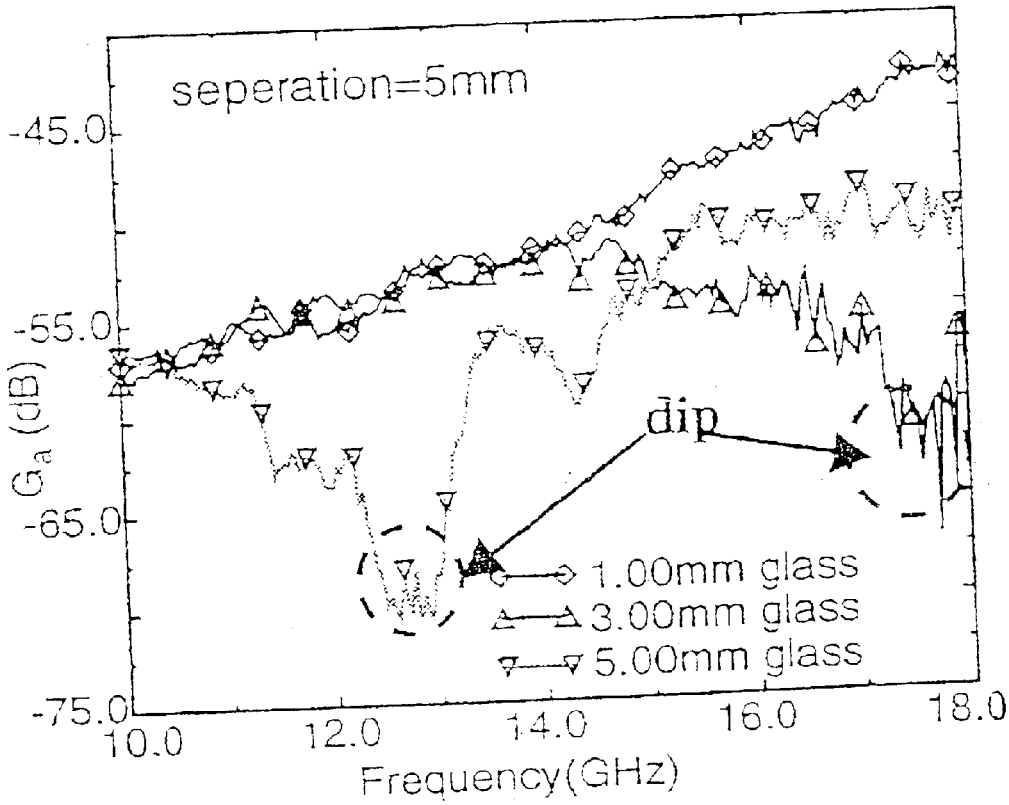
FIG. 5 illustrates power transmission gain vs. frequency for various glass propagating layer thicknesses.
Figure 6:
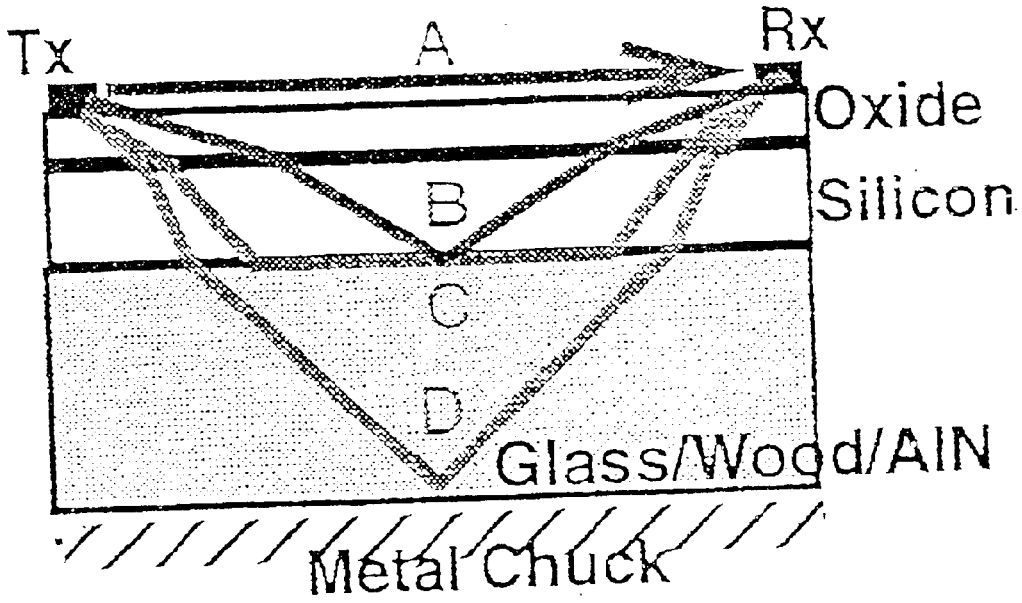
FIG. 6 illustrates electromagnetic wave propagation paths showing reflections from the various material interfaces for the structure shown in FIG. 2.

FIG. 5 and FIG. 6 show that for AlN and glass, respectively, as the dielectric propagating layer thickness is increased, the antenna gain no longer increases monotonically with frequency in the measurement frequency range of 10 GHz to 18 GHz. In addition, as the thicknesses is increased, a dip is seen (most clearly at about 5 mm), and the frequency at which the dip occurs decreases with the AlN layer thickness.

These dips significantly degrade the antenna gain at certain frequencies. The observation of dips in transmission gain likely indicate that the E–M fields in the propagation layer play important roles in signal transmission, especially the path labeled as "D" through the dielectric propagating layer and reflecting off the propagating layer/heat sink interface as shown in FIG. 6. The dips are believed due to the destructive interference among respective waves traveling through different paths shown in FIG. 6.

For AlN, the gain improvement was found to be the greatest for the thicknesses tested when the propagating layer thickness was 0.76 mm. This is helpful because a thin propagating layer improves heat removal by providing a lower thermal resistance as compared to an otherwise equivalent thicker propagating layer. The gain will also generally improve at layer thicknesses thinner than about 0.76 mm. As the operating frequency is increased, the layer thickness can be reduced while maintaining the gain improvement.

Figure 8:
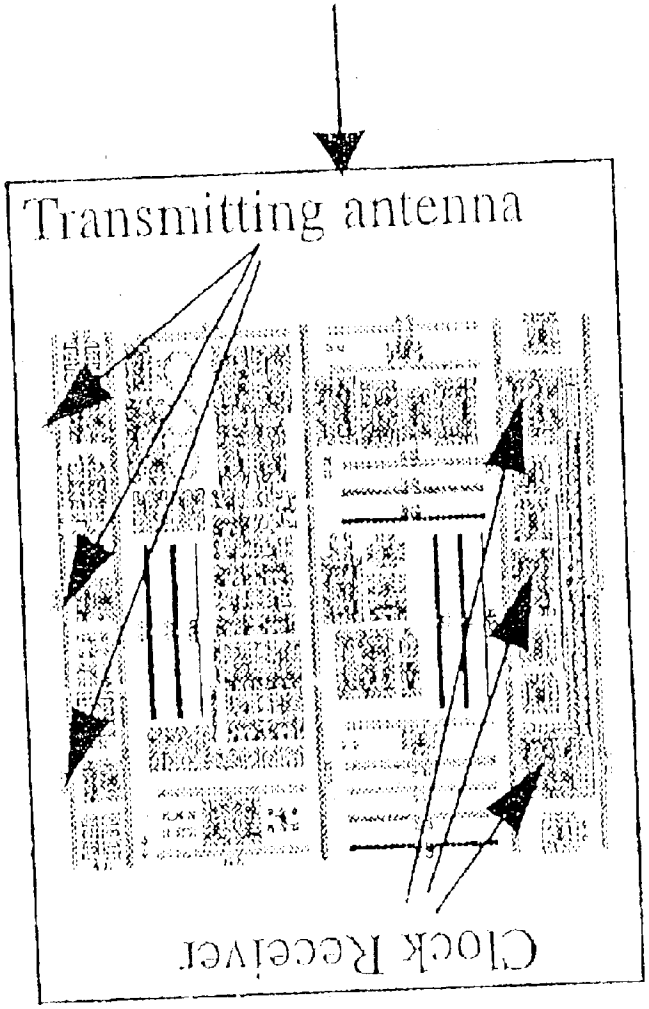
FIG. 8 illustrates layout of 7×6 $mm^2$ test chip containing zigzag integrated dipole antenna and clock receivers.
Figure 9:
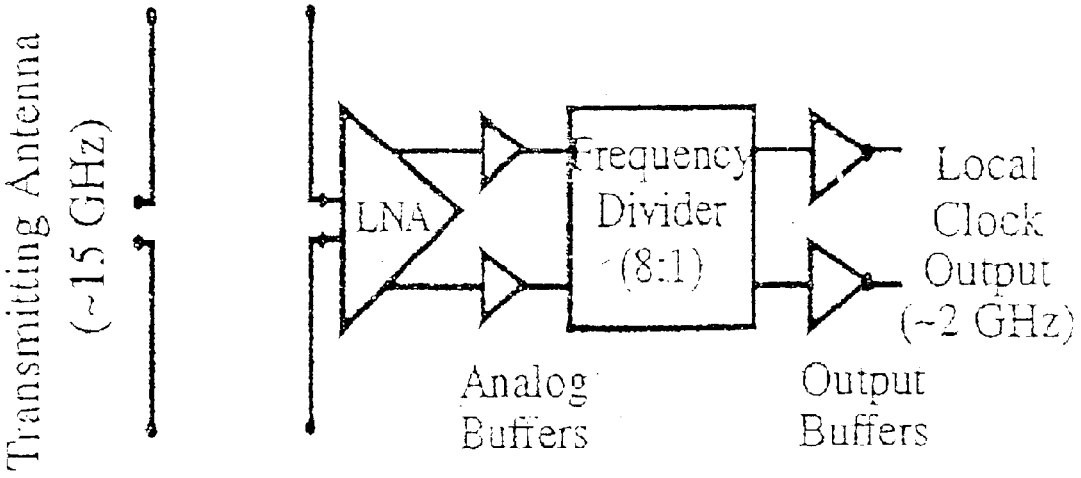
FIG. 9 illustrates a block diagram of the clock distribution system.
Figure 10:
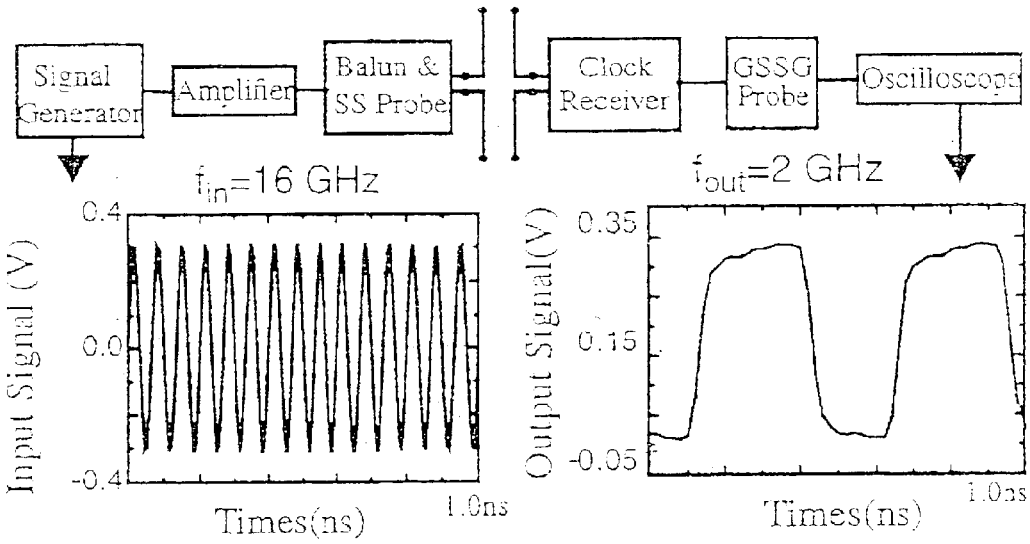
FIG. 10 illustrates measurement setup and input/output wave-form for clock receiver across 5.6 mm distance.

To further demonstrate the feasibility of an AlN propagating layer in a wireless interconnection system, signal transmission between an on-chip transmitting antenna and a clock receiver was characterized on top of the different propagating layers. The receiver shown in FIGS. 7 and 8 was fabricated using a United Microelectronics Corp. of Taiwan (UMC), 0.18 $\mu$m process with 1 $\mu$m thick copper used for the top two metal layers. The receiver was designed to pick up a 14–16 GHz signal from the transmitting antenna and divide it, providing a local clock signal. FIG. 9 provides a block diagram of the clock distribution system employed, while FIG. 10 shows the measurement setup and the input and output waveform for the clock receiver across a 5.6 mm distance.

Sensitivity is defined herein as the minimum transmit power needed to sustain the local clock and is measured as a function of frequency. The sensitivity depends on both the antenna gain and receiver gain, both of which are frequency dependent. Keeping receiver gain constant, FIG. 11 shows the sensitivity of different propagation layers for varying separation distances between the transmitting antenna and receiver.

Figure 11:
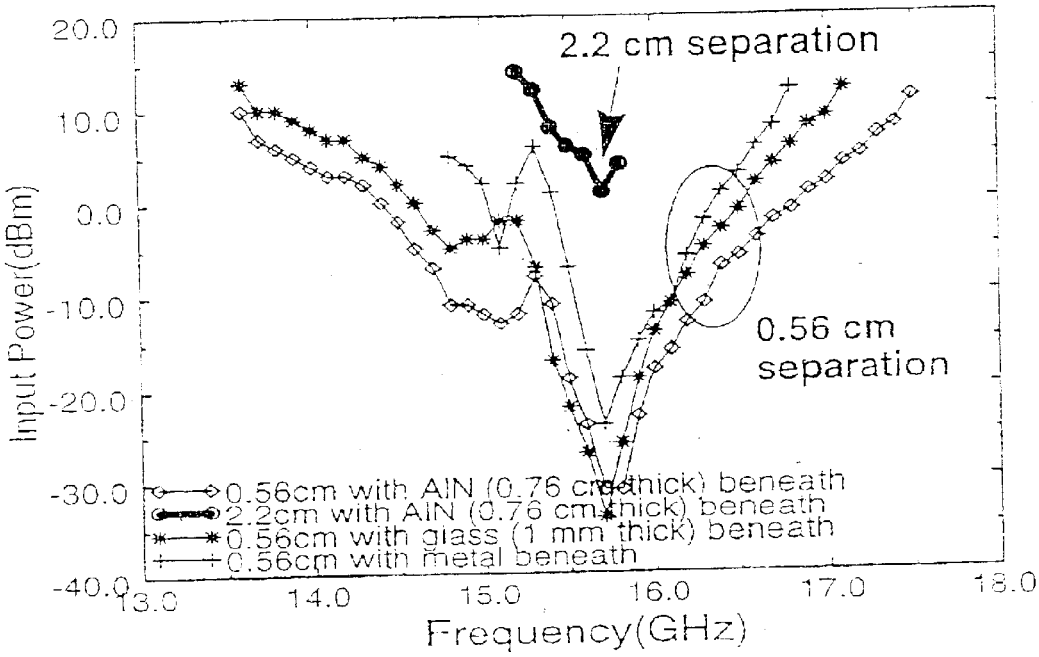
FIG. 11 illustrates measurement of sensitivity vs. frequency with different propagating medium and different distance between antennas.

The measurements shown in FIG. 11 show that AlN provides comparable performance to glass. In addition, AlN provides a much wider frequency range and higher sensitivity than when the wafer is in direct contact with the heat sink. A wider range makes the system more robust to process variations.

Figure 7:
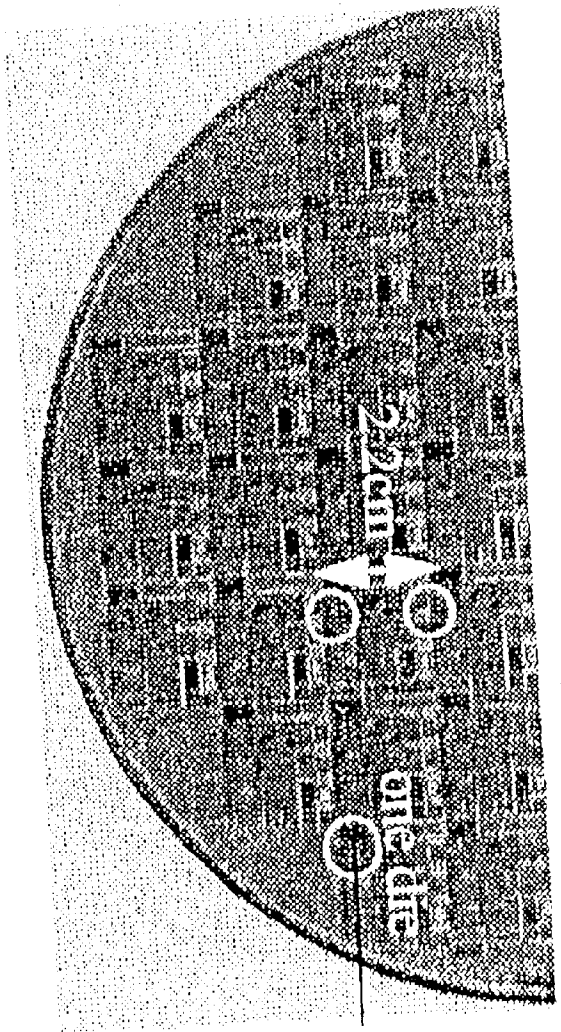
FIG. 7 illustrates a half wafer with multiple dies, and a 2.2 cm measuring condition with transmitting antenna on one die and the receiver on the other die.

FIG. 11 also demonstrates for the first time a wireless connection over a distance of 2.2 cm in an integrated circuit environment. This performance is achieved by using the transmitting antenna on one die and the receiver an another die on the same wafer as shown in FIG. 7. This distance is about three (3) times the previously reported maximum separation distance and larger than that needed for clock distribution on a chip with the maximum die size projected by International Technology Roadmap for Semiconductors (ITRS).

It is to be understood that while the invention has been described in conjunction with the preferred specific embodiments thereof, that the foregoing description as well as the examples which follow are intended to illustrate and not limit the scope of the invention. Other aspects, advantages and modifications within the scope of the invention will be apparent to those skilled in the art to which the invention pertains.

We claim:

1. An integrated circuit adapted for wireless communications, comprising:

a monolithic substrate including at least one integrated electronic device;

at least one integrated antenna formed in or on said substrate;

a heat sink, and at least one dielectric propagating layer disposed between said integrated antenna and said heat sink, said propagating layer providing a bulk thermal conductivity of at least 35 W/m·K and a resistivity of at least 100 Ohm-cm at 25 C.

2. The integrated circuit of claim 1, wherein said dielectric propagating layer is an insert layer comprising a material distinct from said substrate.

3. The integrated circuit of claim 2, wherein said insert layer comprises at least one material selected from the group consisting of aluminum nitride (AlN), sapphire and diamond.

4. The integrated circuit of claim 2, wherein a thickness of said insert layer is between 0.01 to 1 mm.

5. The integrated circuit of claim 1, wherein said circuit provides wireless communications over a distance of at least 1.0 cm.

6. The integrated circuit of claim 1, wherein said circuit provides wireless communications over a distance of at least 2.0 cm.

7. The integrated circuit of claim 1, wherein said monolithic substrate provides said dielectric propagating layer.

8. The integrated circuit of claim 7, wherein said monolithic substrate comprises silicon.

9. The integrated circuit of claim 8, wherein said silicon substrate provides a resistivity of at least 100 Ohm-cm.

10. The integrated circuit of claim 2, wherein said insert layer is in intimate contact with said monolithic substrate.

11. The integrated circuit of claim 1, wherein said at least one integrated electronic device comprises at least a first and second integrated electronic device, said first and second integrated electronic devices each including said integrated antennas, said electronic devices communicating on-chip between one another over the air.

12. The integrated circuit of claim 11, wherein said dielectric propagating layer is an insert layer comprising material distinct from said substrate.

13. The integrated circuit of claim 12, wherein said insert layer comprising at least one selected from the group consisting of aluminum nitride (AIN), sapphire and diamond.

14. The integrated circuit of claim 13, wherein a thickness of said insert layer is between 0.01 to 1 mm.

15. The integrated circuit of claim 11, wherein said circuit provides on-chip wireless communications over a distance of at least 1.0 cm.

16. The integrated circuit of claim 11, wherein said circuit provides on-chip wireless communications over a distance of at least 2.0 cm.

17. The integrated circuit of claim 11, wherein at least one of said first and second integrated electronic devices comprises a microprocessor.

* * * * *